US008776477B2

(12) United States Patent
Sprague

(10) Patent No.: US 8,776,477 B2
(45) Date of Patent: Jul. 15, 2014

(54) ARCHITECTURAL ALIGNMENT SYSTEM

(75) Inventor: Gary Sprague, Los Angeles, CA (US)

(73) Assignee: C.R. Laurence Company, Inc., Los Angeles, CA (US)

( * ) Notice: Subject to any disclaimer, the term of this patent is extended or adjusted under 35 U.S.C. 154(b) by 0 days.

(21) Appl. No.: 13/051,653

(22) Filed: Mar. 18, 2011

(65) Prior Publication Data

US 2011/0225925 A1 Sep. 22, 2011

Related U.S. Application Data

(60) Provisional application No. 61/315,851, filed on Mar. 19, 2010.

(51) Int. Cl.
*E04B 1/00* (2006.01)
*E04G 21/00* (2006.01)
*E04G 23/00* (2006.01)

(52) U.S. Cl.
USPC . 52/745.05; 52/126.3; 52/126.5; 52/204.597; 52/204.64; 43/255; 43/311

(58) Field of Classification Search
USPC ..... 52/126.3, 126.5, 241, 204.597, 204.64, 52/800.14, 834; 403/252, 255, 264, 311; 256/25, 65.01
See application file for complete search history.

(56) References Cited

U.S. PATENT DOCUMENTS

| | | | | | |
|---|---|---|---|---|---|
| 3,866,370 | A * | 2/1975 | Guarino et al. | 52/241 |
| RE28,643 | E * | 12/1975 | Blum | 256/24 |
| 4,612,743 | A * | 9/1986 | Salzer | 52/208 |
| 4,784,364 | A * | 11/1988 | Chamberlain et al. | 248/673 |
| 6,554,542 | B2 * | 4/2003 | Mano et al. | 405/251 |
| 7,866,636 | B1 * | 1/2011 | Hansen | 256/65.14 |
| 2002/0195595 | A1 * | 12/2002 | Shepherd | 256/25 |
| 2005/0236612 | A1 * | 10/2005 | Platt | 256/67 |
| 2009/0173019 | A1 * | 7/2009 | Pryor et al. | 52/167.4 |

OTHER PUBLICATIONS

Dictionary.com definition of "concave": http://dictionary.reference.com/browse/concave.*
Dictionary.com definition of "convex": http://dictionary.reference.com/browse/convex?s=t.*

* cited by examiner

*Primary Examiner* — Brian Glessner
*Assistant Examiner* — Brian D Mattei
(74) *Attorney, Agent, or Firm* — Mitchell P. Brook; McKenna Long & Aldridge LLP

(57) ABSTRACT

A system of aligning a panel comprising a base shoe having two side walls and a concave base surface and a mounting pad having a substantially flat bottom surface and a convex top surface corresponding to the concave base surface of the base shoe. When the mounting pad is disposed beneath the concave base surface of the base shoe the system achieves vertical plumb. Each side wall of the base shoe may define at least one groove therein.

7 Claims, 15 Drawing Sheets

ARCHITECTURAL ALIGNMENT SYSTEM

CROSS-REFERENCE TO RELATED APPLICATION

This application claims priority to U.S. Patent Application Ser. No. 61/315,851, filed Mar. 19, 2010, which is incorporated by reference herein in its entirety.

FIELD OF THE INVENTION

The present invention relates to architectural alignment systems. More particularly, the invention relates to systems for holding panels in alignment.

BACKGROUND OF THE INVENTION

Panel systems, particularly glass panel railing systems, are used in commercial spaces and homes, and frequently are desired due to an attractive appearance derived from transparent or translucent properties. They typically are used as guard rails at the edge of a physical drop, for traffic control or for partitioning of spaces. Known glass panel systems include vertical panels and a base shoe assembly. The bottom edges of the panel are installed in the base shoe while the top edges may support a top rail or handrail.

However, aligning panels so the panel system is plumb and level can be difficult. Panel systems often are installed on undulating surfaces. This is particularly common in outdoor installations, where surfaces may be uneven. In such cases, as the mounting surface changes in angle the glass tends to rotate, causing unsightly misalignment and deformities in the glass. This is particularly so in panel systems that lack top rail components. In addition, certain installment circumstances, such as an orchard railing or pony wall used as a windscreen, preclude the use of mechanical components at the top of the panel to maintain alignment.

Known flat panel alignment systems and methodology suffer from a number of disadvantages. One common solution is to insert long shim strips on both sides under the base shoe. However, this approach can be difficult because very slight shim thickness variations produce undesirable panel misalignment, and shim stack thicknesses will vary from the man side to the drop side of the guard rail. It is also time consuming to determine and insert the right type and number of shim strips effective to achieve vertical plumb. Even if the shim strips of the correct thickness are available, this does not always result in perfect alignment of the panel. Another mechanism entails use of a top cap component to align the panel. But forcing a misaligned large glass panel into a top cap is also difficult.

A further drawback of existing flat panel alignment systems is that the base shoe component can be very heavy, which may cause stress on the mounting substrate. This will contribute to the need for larger structural supporting members. Heavy components also may cause higher shipping costs as the overall weight of the shipped components drives up price.

Thus, there is a need for an architectural alignment system that is easy to use and achieves effective alignment of a panel system. More particularly, there is a need for an architectural alignment system that eliminates the need for difficult insertion of shim strips underneath the base shoe to achieve alignment of a panel system on uneven or irregular surfaces. There also exists a need for an architectural system having a lighter base shoe to reduce manufacturing and shipping costs and ease stress on the mounting substrate. Therefore, there is a need for an easy to use, lower weight architectural alignment system that achieves alignment of panel systems without the use of extra components requiring excessive force.

SUMMARY OF THE INVENTION

The present invention, in its many embodiments, alleviates to a great extent the disadvantages of known architectural alignment systems by providing a system of aligning a panel system using a specially designed base shoe and mounting pad alignment mechanism. Panel systems may be easily and effectively aligned without the need to apply excessive forces to insert components into the base shoe or force the top of a glass panel into a top cap component. Embodiments of a base shoe are specially designed to eliminate unnecessary material to reduce the weight of the base shoe, thereby reducing the chances of damaging the base shoe's mounting surfaces and reducing shipping costs. Embodiments of the present invention are well-suited for panel railing systems having panels and flat glass panels in particular. However, it should be noted that the principles and embodiments described herein are applicable to panels made from a variety of materials such as metal or plastic.

Embodiments of the present invention include a system of aligning a panel comprise a specially designed base shoe and mounting pad. The base shoe defines a channel and has two side walls and a concave base surface. The mounting pad has a substantially flat bottom surface and a convex top surface corresponding to the concave base surface of the base shoe. When the mounting pad is disposed beneath the concave base surface of the base shoe the system achieves vertical plumb. One or more shims may be provided, such as in a set of three shims with each shim having a different thickness. The shims are adapted to be disposed beneath the mounting pad. The mounting pad may be substantially horse shoe shaped, and the shims may be horseshoe shims.

Each side wall of the base shoe defines at least one groove therein and may define a plurality of grooves. These grooves are extruded to remove unnecessary material. The resulting base shoe is lighter in weight than existing base shoes. Thus, the base shoe exerts less stress on the mounting substrate and may reduce shipping costs. Embodiments of the system architectural alignment system also may include a fascia mounting assembly that can be used for horizontal mounting on the side surface of a building structure. In an example, the fascia mounting assembly includes the mounting pad, a fascia mount and at least one shim.

Embodiments may further comprise a panel locking assembly disposed within the channel of the base shoe. In one example, a panel locking assembly includes a spacer, a first tapered plate and a second tapered plates. The first tapered plate can have a first end and a second end and is tapered such that the first end is thinner than the second end. Similarly, the second tapered plate can have a first end and a second end and is tapered such that the first end is thinner than the second end. The first and second plates are insertable between a side wall of the base shoe and a panel in overlapping relation. Moving the second plate laterally towards the first plate serves to generate a compressive force on the panel, and moving the plates laterally apart serves to reduce the compressive force on the panel.

In further embodiments, an adjustable angle base shoe assembly is provided for glass railing systems comprising a substantially U-shaped extrusion having an inner channel, a curved base and two side walls and a curved block adapted to be disposed beneath the curved base of the extrusion. When the curved block is disposed beneath the curved base of the extrusion the base shoe assembly achieves vertical plumb.

The present disclosure further contemplates methods of aligning a panel system. Such methods comprise providing a base shoe and a mounting pad. The base shoe defines a channel and has two side walls and a concave base surface, and each side wall of the base shoe defines at least one groove therein. The mounting pad has a substantially flat bottom surface and a convex top surface corresponding to the concave base surface of the base shoe. The methods include placing the base shoe on a mounting substrate and inserting the mounting pad under the base shoe such that the convex top surface of the mounting pad is adjacent the concave base surface of the base shoe. The base shoe may be loosely bolted to the mounting substrate and the panel system adjusted to achieve vertical plumb. One or more shims may be inserted beneath the mounting pad to make the panel level.

Disclosed methods may further comprise inserting a panel locking assembly within the channel of the base shoe and installing a panel into the panel locking assembly. The panel installation may comprise inserting a spacer into the base shoe and resting a panel on the spacer. Subsequent panel installation steps may include inserting a first tapered plate into the base shoe between one of the base shoe sidewalls and the panel and inserting a second tapered locking plate into the base shoe. In one example, the second tapered locking plate is inserted between one of the base shoe sidewalls and the panel so that it is at least partially overlapping with the first tapered locking plate. This results in the first tapered locking plate being partially positioned between the second tapered locking plate and the panel. Finally, the method comprises moving one or both of the first tapered locking plate and the second tapered locking plate laterally in relation to one another to generate a compressive force on the panel.

These and other features and advantages of the present invention will be appreciated from review of the following detailed description of the invention.

BRIEF DESCRIPTION OF THE DRAWINGS

The foregoing and other objects of the invention will be apparent upon consideration of the following detailed description, taken in conjunction with the accompanying drawings, in which.

DETAILED DESCRIPTION

Figure 1:
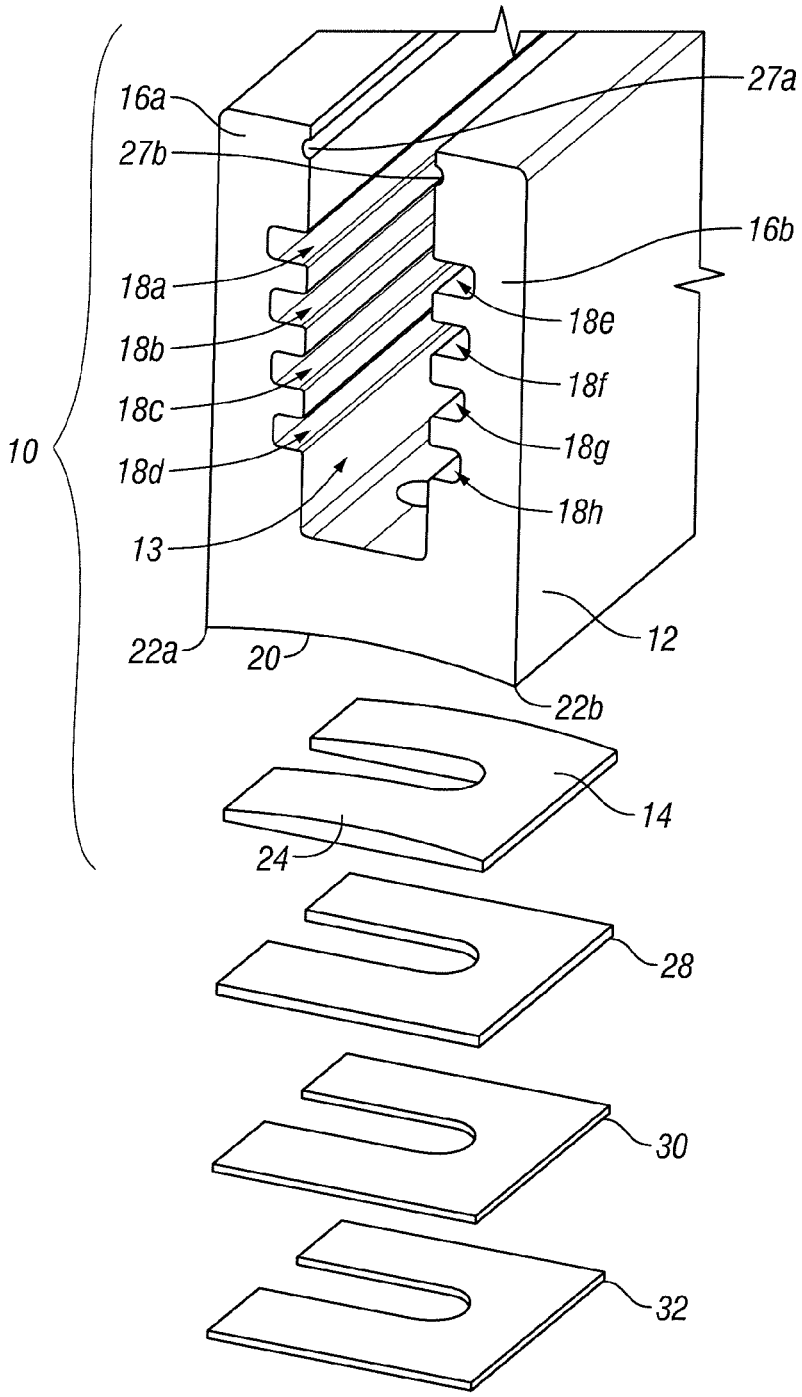
FIG. 1 is a perspective view of an embodiment of an architectural alignment system in accordance with the present invention.
Figure 2:
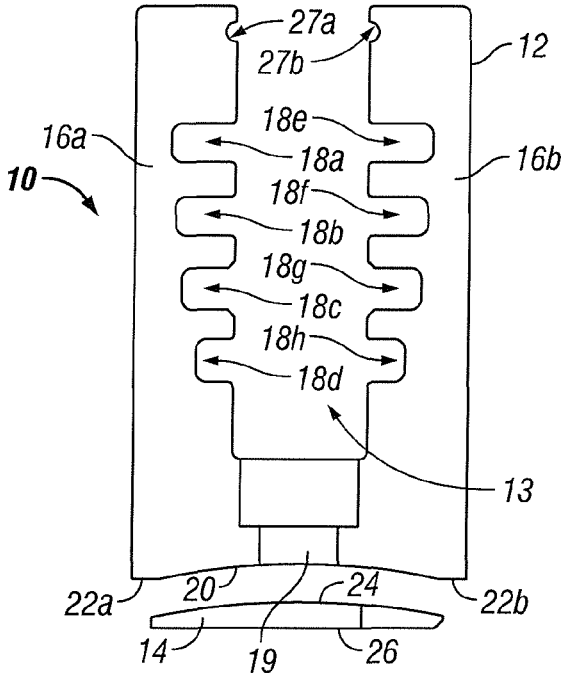
FIG. 2 is a front view of an embodiment of an architectural alignment system in accordance with the present invention shown with a panel and a base shoe.
Figure 3:
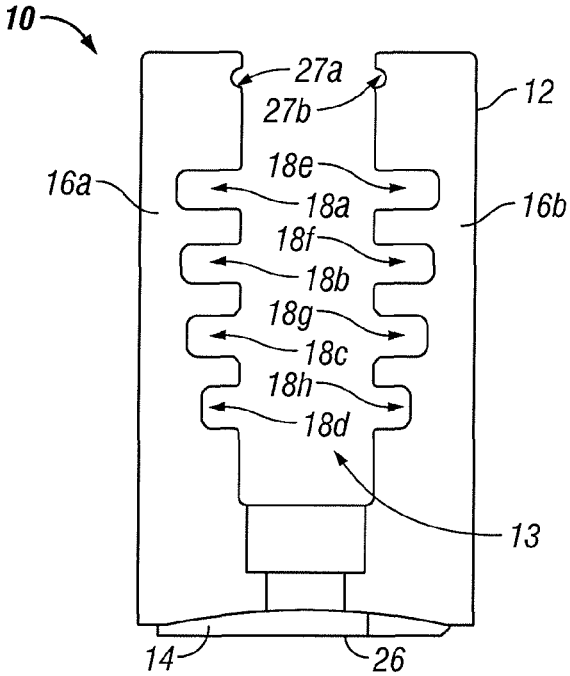
FIG. 3 is a front view of an embodiment of an architectural alignment system in accordance with the present invention shown with a mounting pad attached to the base shoe.
Figure 4:
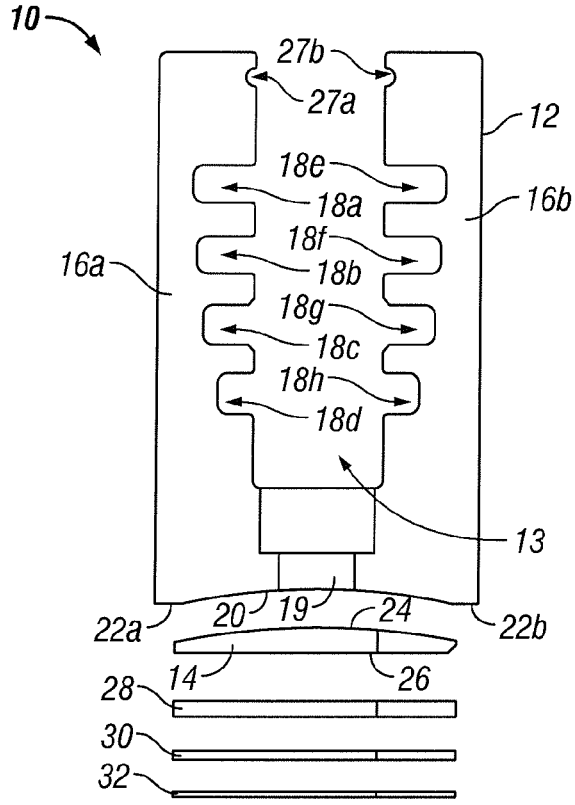
FIG. 4 is a front view of an embodiment of an architectural alignment system in accordance with the present invention shown with a set of shims.
Figure 5:
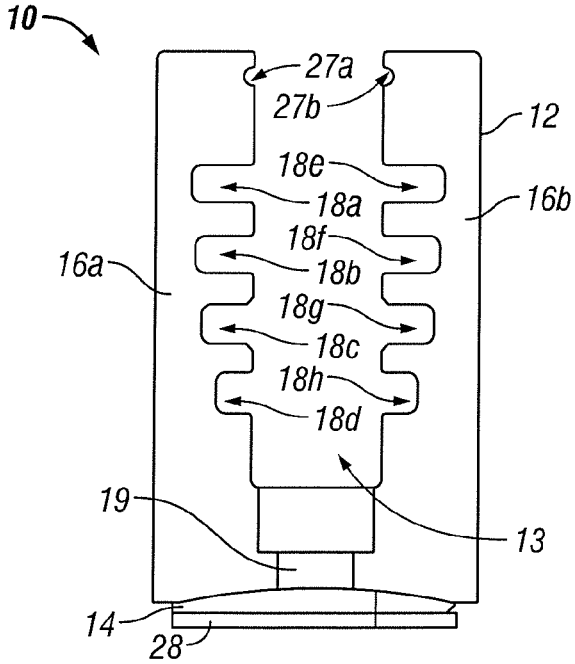
FIG. 5 is a front view of an embodiment of an architectural alignment system in accordance with the present invention shown with a mounting pad and shim attached to the base shoe.
Figure 6:
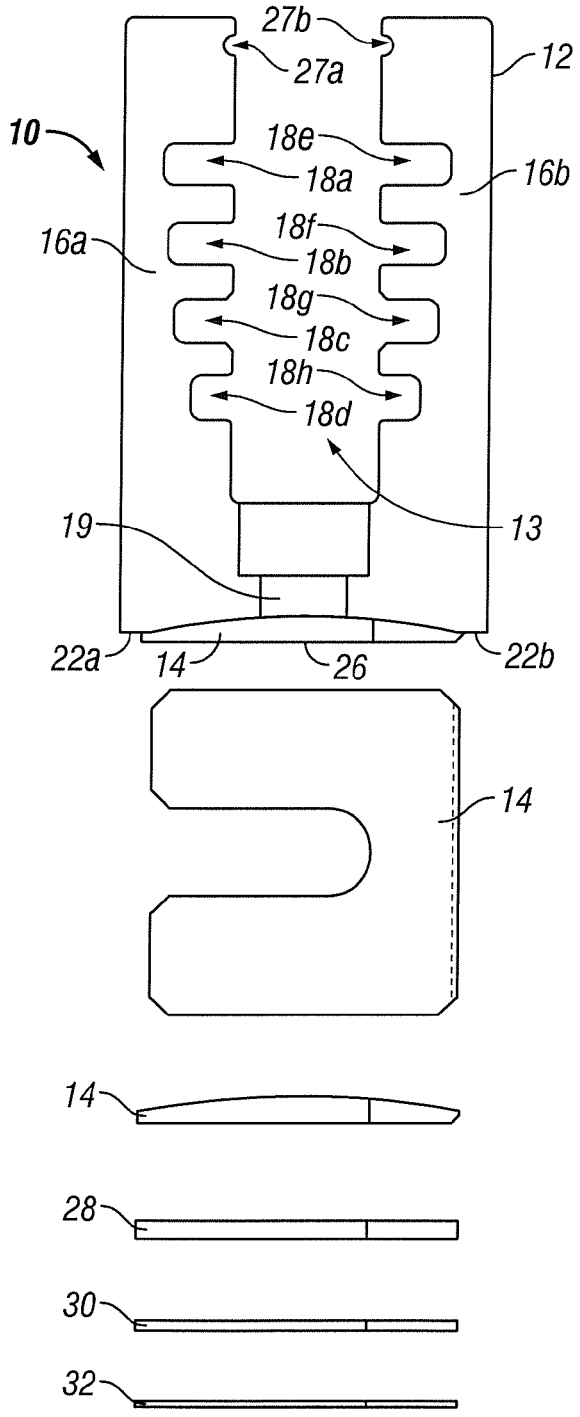
FIG. 6 is a front view of an embodiment of an architectural alignment system in accordance with the present invention shown with a top view of a horseshoe shim.
Figure 7:
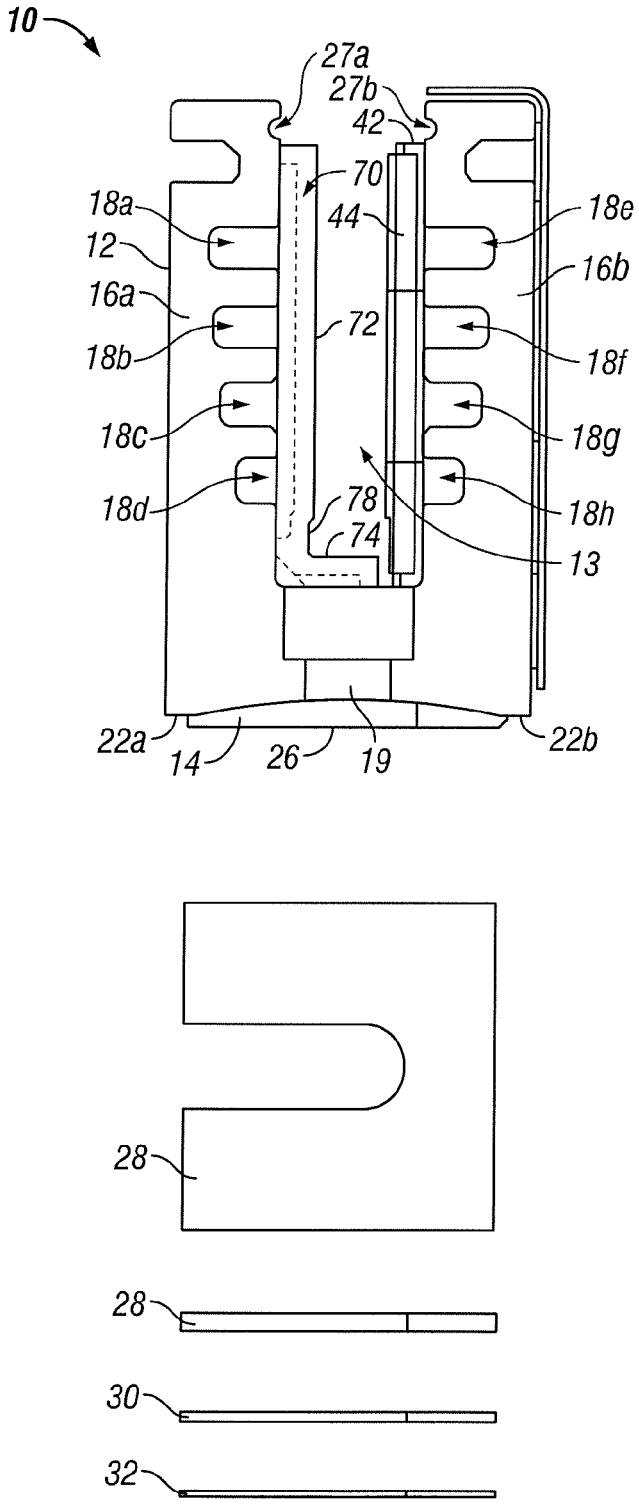
FIG. 7 is a front view of an embodiment of an architectural alignment system in accordance with the present invention shown with an embodiment of a panel locking system disposed within the base shoe.

In the following paragraphs, embodiments of the present invention will be described in detail by way of example with reference to the accompanying drawings. Throughout this description, the embodiments and examples shown should be considered as exemplars, rather than as limitations on the present invention. As used herein, the "present invention" refers to any one of the embodiments of the invention described herein, and any equivalents. Furthermore, reference to various aspects of the invention throughout this document does not mean that all claimed embodiments or methods must include the referenced aspects.

Referring to FIGS. 1-6, an embodiment of an architectural alignment system is shown. Architectural alignment system 10 comprises base shoe 12 and mounting pad 14. Base shoe 12 is a substantially U-shaped structure defining a channel 13 and having two side walls 16*a*, 16*b*. Each side wall defines at least one groove 18 and optionally defines a plurality of grooves 18*a*-18*h*. The grooves 18*a*-18*h* are extruded as an element of the side walls 16*a*, 16*b* and are substantially perpendicular to the side walls. The side walls 16*a*, 16 be define top grooves 27*a*, 27*b* at the upper ends of the side walls. Grooves 18*a*-18*h* provide an interlock for a continuous roll-in rubber gasket (not shown) that can serve as a weather barrier as well as an aesthetic finish. The material removed to form grooves 18*a*-18*h* is unnecessary for the functioning of the base shoe 12, and the result is a base shoe lighter in weight than existing base shoes. Specifically, the grooved design lowers the overall weight of the base shoe 12 by approximately 15 percent.

Due to this reduction in weight, base shoe 12 exerts less stress on the mounting substrate on which the architectural alignment system and panel system is mounted. Thus, outdoor surfaces, such as patios and walkways, are less likely to incur damage such as cracking or splintering. Similarly, indoor floors are less likely to be warped or damaged by the panel system and alignment system. The reduced weight also may lower shipping costs because such costs often vary based on the weight of the shipment. The base shoe may be made of any material of suitable strength to support a panel system. Aluminum has advantages as the material in that it can be relatively lightweight and readily recyclable. Using recyclable material reduces the environmental impact of the architectural alignment system.

Base shoe 12 is an aluminum extrusion featuring a concave base surface 20 and two outer substantially flat edge surfaces 22*a*, 22*b* that contact the mounting substrate. Mounting pad 14 is a block having a convex top surface 24 and a substantially flat bottom surface 26. In one example, mounting pad 14 is made of aluminum, but any material of sufficient strength to support base shoe 12 and a panel system can be used. The curvature of the convex top surface 24 of mounting pad 14 corresponds to the curvature of the concave base surface 20 of base shoe 12. As described in more detail herein, when mounting pad 14 is disposed beneath the concave base surface 20 of base shoe 12 the panel system supported by architectural alignment system 10 achieves vertical plumb. More particularly, mounting pad 14 is slotted to allow for minor adjustment to its placement so base shoe 12 can be adjusted to perfect plumb.

In one embodiment, mounting pad 14 has a U-shaped or "horseshoe" configuration. Its thickness may vary, and in one example the length and width dimensions can be are 2⅛"× 2¼" (54×57 mm), although any dimension may be used for these components and other components of the assembly. Additionally, one or more shims may be provided for use with mounting pad 14, such as, for example, in a set of three shims 28, 30, 32 with each shim having a different thickness. Examples of thicknesses are, for shim 28, ⅛" (3.2 mm), for shim 30, 1/16" (1.6 mm), and for shim 32, 1/32" (0.8 mm), although other thicknesses can be used. In this embodiment, shims 28, 30, 32 are of substantially the same length and width as mounting pad 14 and are adapted to be disposed beneath the mounting pad 14 to adjust the height of the architectural alignment system 10. Shims 28, 30, 32 are horseshoe shims of a shape that provides a suitable architectural fit with the same shape as mounting pad 14.

Figure 8:
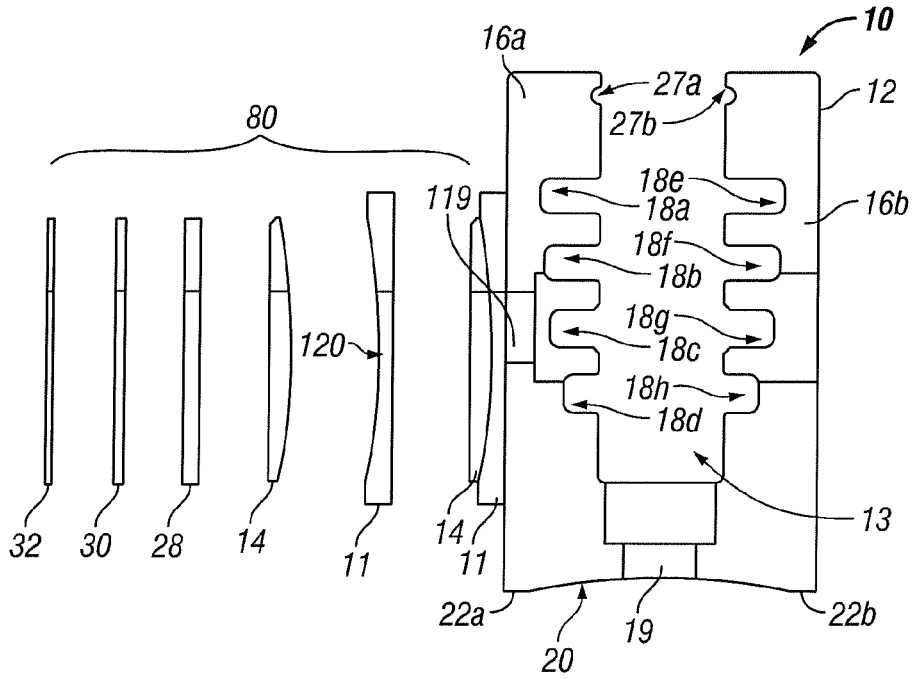
FIG. 8 is a front view of an embodiment of an architectural alignment system configured as a fascia mounting system in accordance with the present invention.
Figure 9:
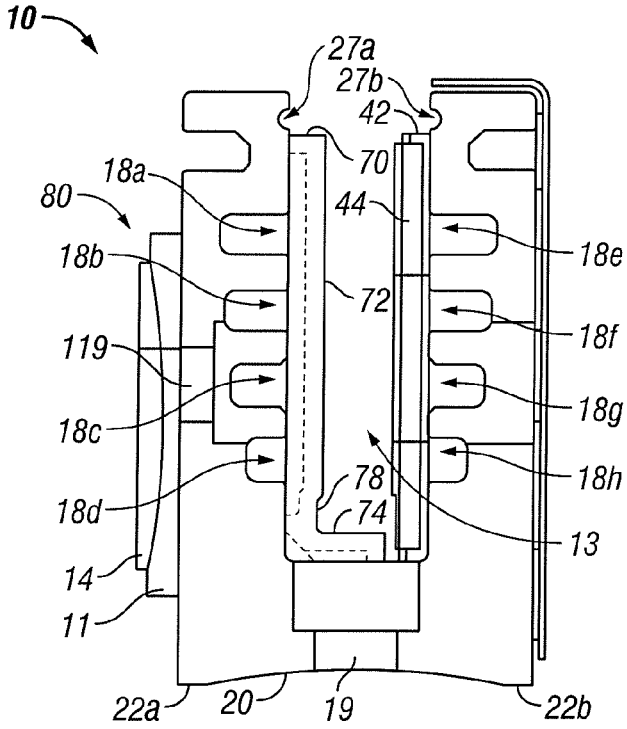
FIG. 9 is a front view of an embodiment of an architectural alignment system configured as a fascia mounting system in accordance with the present invention shown with an embodiment of a panel locking system disposed within the base shoe.

Embodiments of the architectural alignment system may further comprise a fascia mounting assembly 80 for side mounting of panel system. Referring to FIGS. 8 and 9, fascia mounting assembly 80 comprises mounting pad 14 and shims 28, 30 and 32. Fascia mount 11 is attached to side 16*a* of base shoe 12 and provides a concave surface 120 to attach mounting pad 14 to the base shoe 12. It should be noted that, instead of a separate fascia mount component 11, a custom base shoe could be made that incorporates a continuous concave curve into the side of the base shoe. The base shoe 12 can then be bolted through its side 16*a* to a side wall surface. If needed, shims 28, 30 or 32 can be disposed between the side wall surface and mounting pad 14 adjust the distance between the building structure and the panel system. The fascia mounting assembly 80 advantageously provides point contacts with a building structure instead of a single, continuous contact, which allows the building to undulate.

Figure 16:
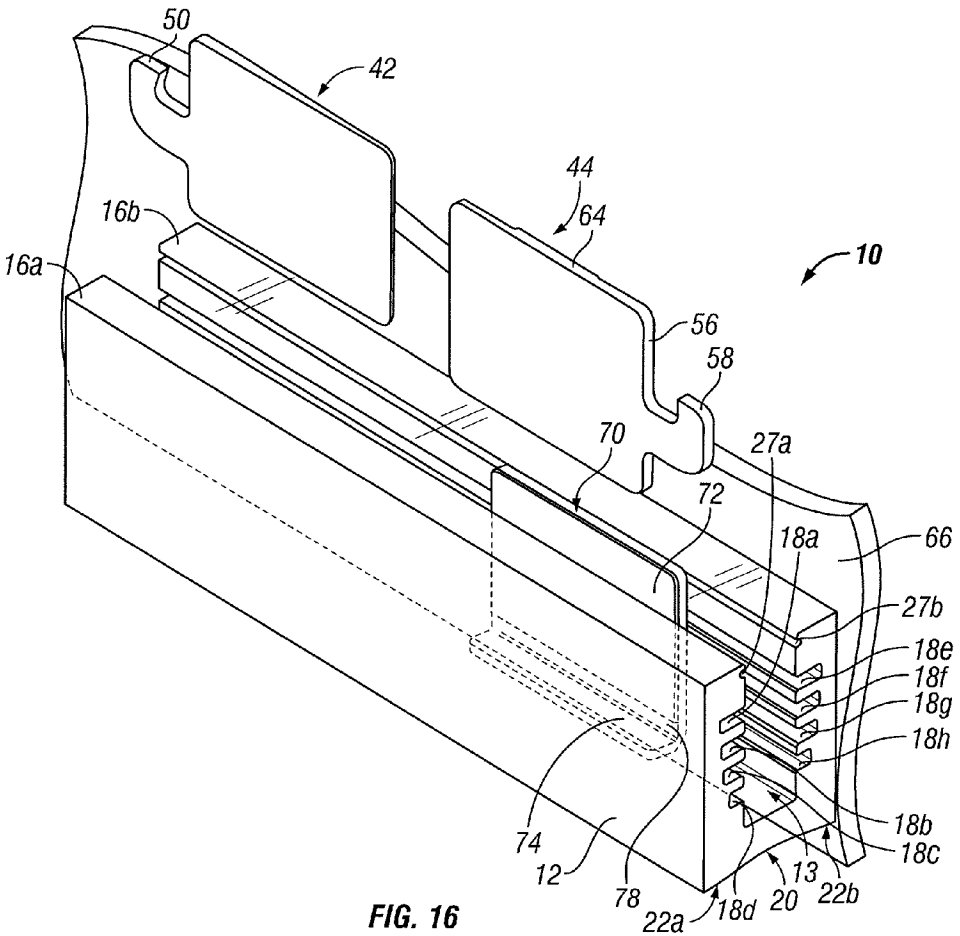
FIG. 16 is a perspective view of an embodiment of a panel locking system in accordance with the present invention shown with an embodiment of a base shoe and panel.
Figure 17:
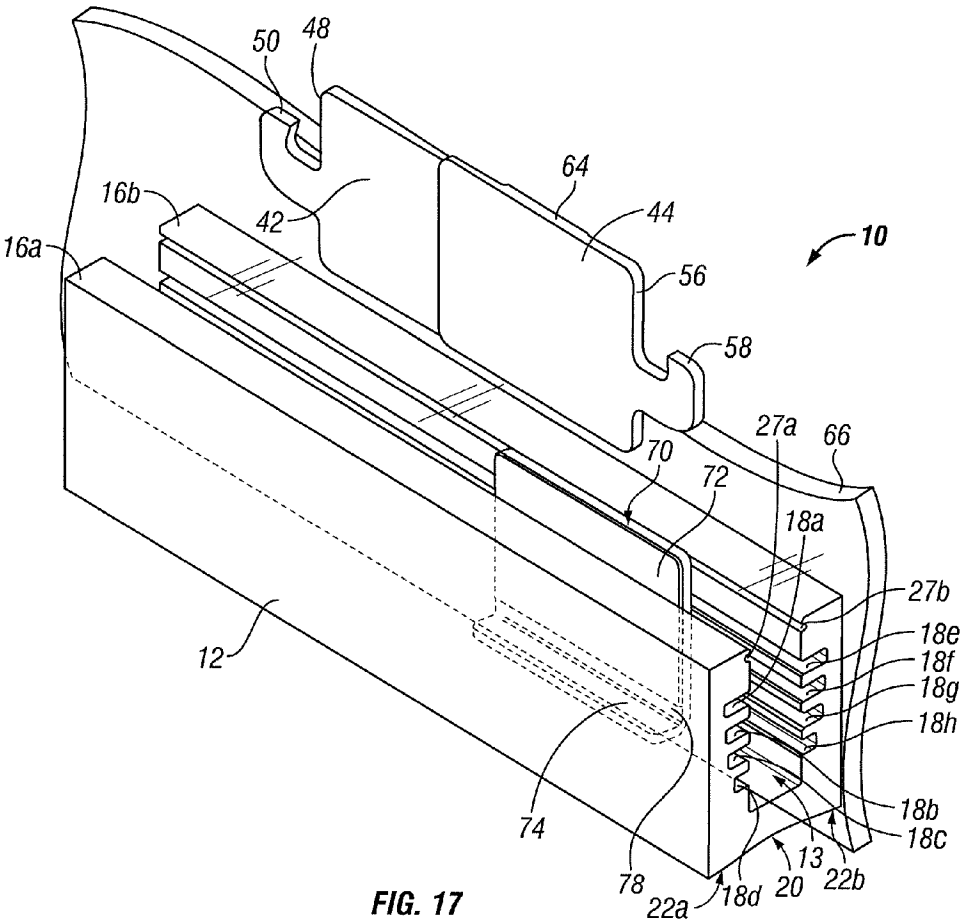
FIG. 17 is a perspective view of an embodiment of a panel locking system in accordance with the present invention shown with an embodiment of a base shoe and panel.

Architectural alignment system 10 may further comprise a panel locking assembly 40. An example of a suitable panel locking assembly is described in U.S. patent application Ser. No. 12/119,420, filed May 12, 2008, which is incorporated by reference herein in its entirety. Panel locking assembly 40 may be disposed within channel 13 of base shoe 12 and locks a glass panel in place. An exemplary embodiment of panel locking assembly 10 comprises first plate 42 and second plate 44. The two plates have similar and complementary tapered structure. First plate 42 has a first end 46 and a second end 48 and is tapered such that the plate is thinner at the first end than at the second end. First plate 42 further has a projection tab 50. As shown in FIGS. 16 and 17, projection tab 50 extends from the second end of the plate at an intermediate point at second end 18. Optional jib projection 52 on the top of first plate 42 which engages second plate 44.

Second plate 44 comprises first end 54 and second end 56. The second plate also is tapered so the first end 54 is thinner than the second end 56 and has a projection tab 58 extending from the second end at an intermediate point. As will be described in more detail herein, projection tab 58 receives the outward or separating force when the two plates are separated during extraction. In an embodiment shown in FIG. 16, the projection tab may be an upward projection 64 from the top of the plate. Projection tabs 50 and 58 optionally have hook-shaped profiles, although other suitable profiles may be used. Both plates have a flat side and a tapered side, and as second plate 14 moves toward first plate 42 and the two plates fixedly engage each other, the tapered sides contact each other. The plates are insertable between a side wall 74 of base shoe 12 and a glass panel 66 in overlapping relation with the flat side of second plate 44 contacting the flat panel 66 being installed, and the flat side of first plate 42 contacting the front wall of the base shoe 12.

Below the plates there is provided a spacer 70 to space the panel 66 from the base shoe 12. Spacer 70 also serves to support the panel 66 and protect the bottom of the panel as it is lowered into base shoe 12. Multiple spacers may be inserted in the base shoe 12 spaced apart approximately 14 inches from center to center, the number of spacers depending on the length of the panel to be installed. The spacer 70 may have a long leg 72 and a short leg 74 and in this example, forms a substantially L-shaped cross section. However, other structures may be used, such as a U-shape or any other configuration that provides support for a panel during installation. A strip of double-sided tape 76 may be provided on the top surface of short leg 74 to facilitate attachment and secure the panel 66 to the spacer 70. With the panel 66 disposed in the "L" of spacer 70, only the person side surface is exposed during installation; the lower back side and the bottom of the panel 66 are protected by the long leg 72 and short leg 74, respectively, of the spacer.

Panel 66 is further protected by an additional structural feature of spacer 70, namely recess 78 located on the spacer at the transition of long leg 72 and short leg 74. Recess 78 protects the bottom edge of the panel 66 from forces applied during the installation process that may exert stress on the panel. Recess 78 also serves to protect the glass panel's fragile edges during moments of lateral load, load resulting from wind, seismic movement, equipment and human applied force. The structure of spacer 70 also may include vertical ribs on the back side of long leg 72 controlling the maximum part thickness, thereby producing a flat part of consistent thickness tolerance. The spacer 70 optionally is manufactured by plastic injection molding rather than by extrusion, which results in a stronger component having better tolerances.

Figure 10:
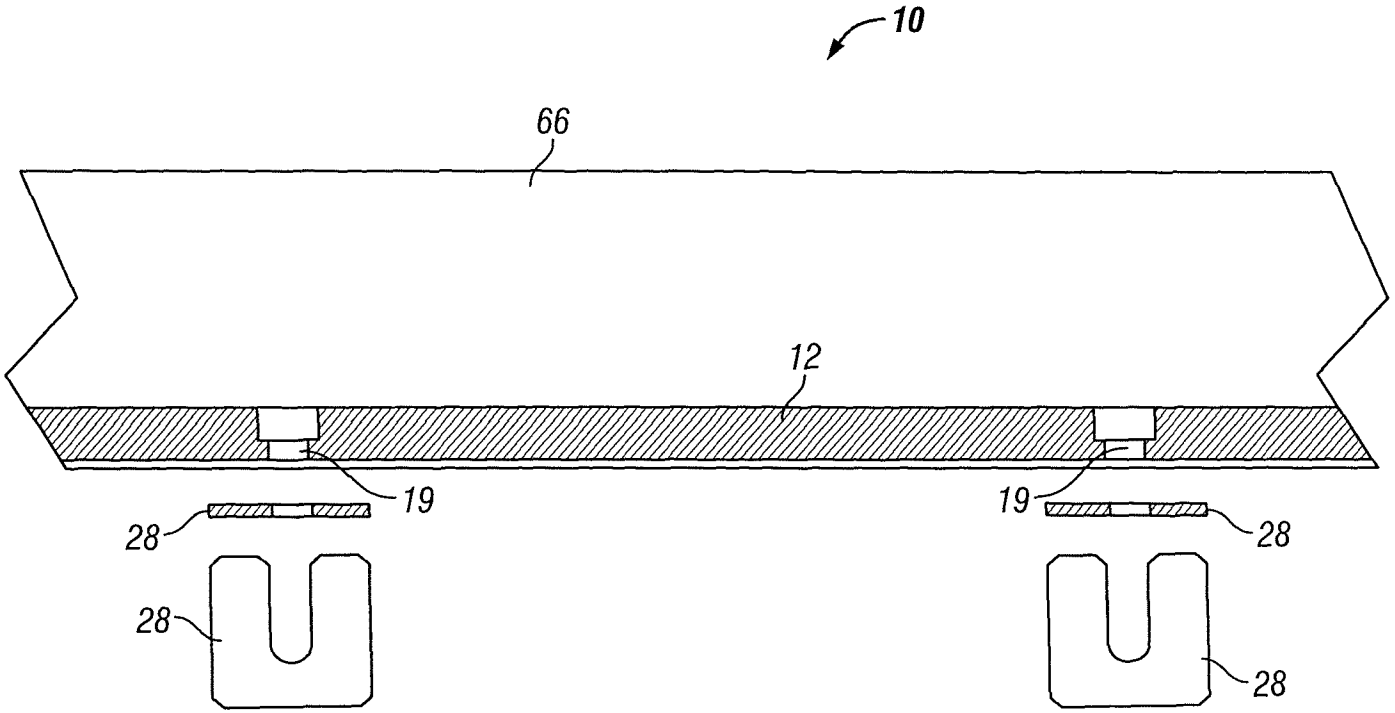
FIG. 10 is a side view of an embodiment of an architectural alignment system in accordance with the present invention shown with a panel system.
Figure 11:
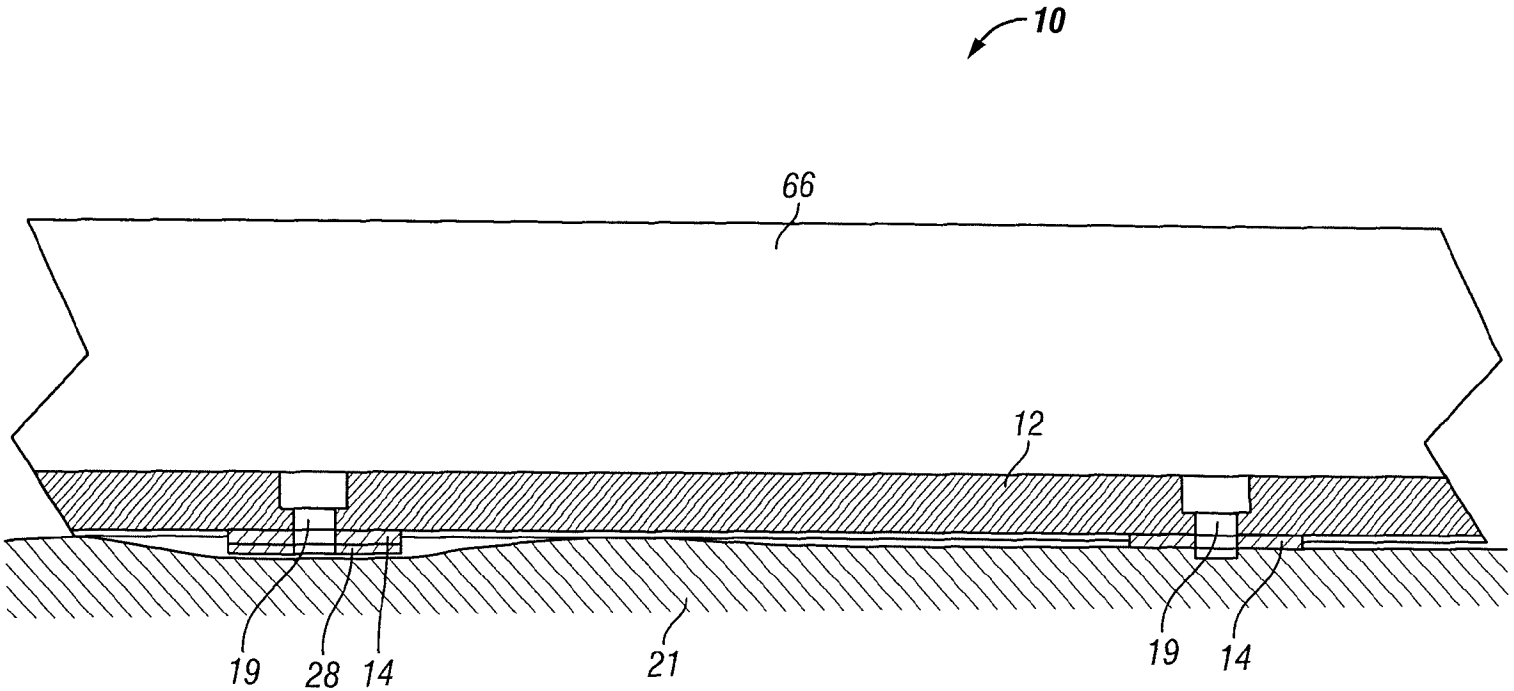
FIG. 11 is a side view of an embodiment of an architectural alignment system in accordance with the present invention shown with a panel system.
Figure 12:
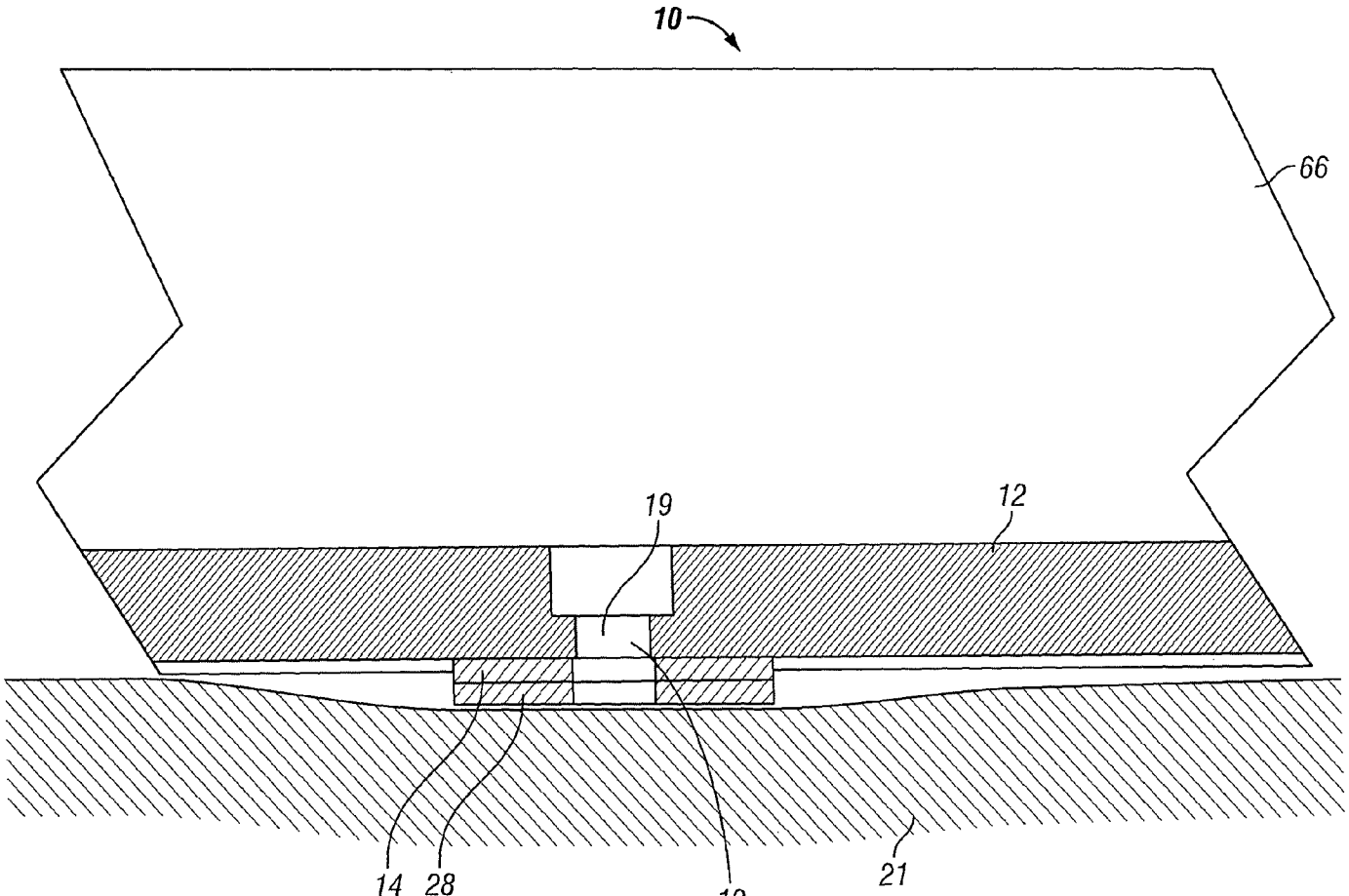
FIG. 12 is a side view of an embodiment of an architectural alignment system in accordance with the present invention shown with a panel system.

In operation, the installer places base shoe 12 in its intended position on the mounting substrate 21, aligns it laterally and then drills holes for the mounting bolts. Both ends of base shoe 12 are then elevated using a stack of horseshoe shims 28, 30, 32 measuring ¼". With the convex top surface 24 of mounting pad 14 facing upwards, and the channel 13 of base shoe 12 away from the man side of the railing, the installer places one mounting pad 14 under each mounting bolt hole 19 location, as best seen in FIGS. 10 and 11. The mounting pads 14 are then centered and aligned so they are parallel with the length of base shoe 12. Base shoe 12 is then loosely bolted to the mounting substrate 21 so the bolts are disposed short of the full depth. The installer then removes the temporary shims 28, 30, 32 to allow base shoe 12 to rest upon mounting pads 13. As shown in FIGS. 11 and 12, if the mounting substrate has irregular dips, one or more of the shims 28, 30, 32 of appropriate thickness may be inserted under mounting pad 14 to fill the gaps and achieve level.

Figure 13:
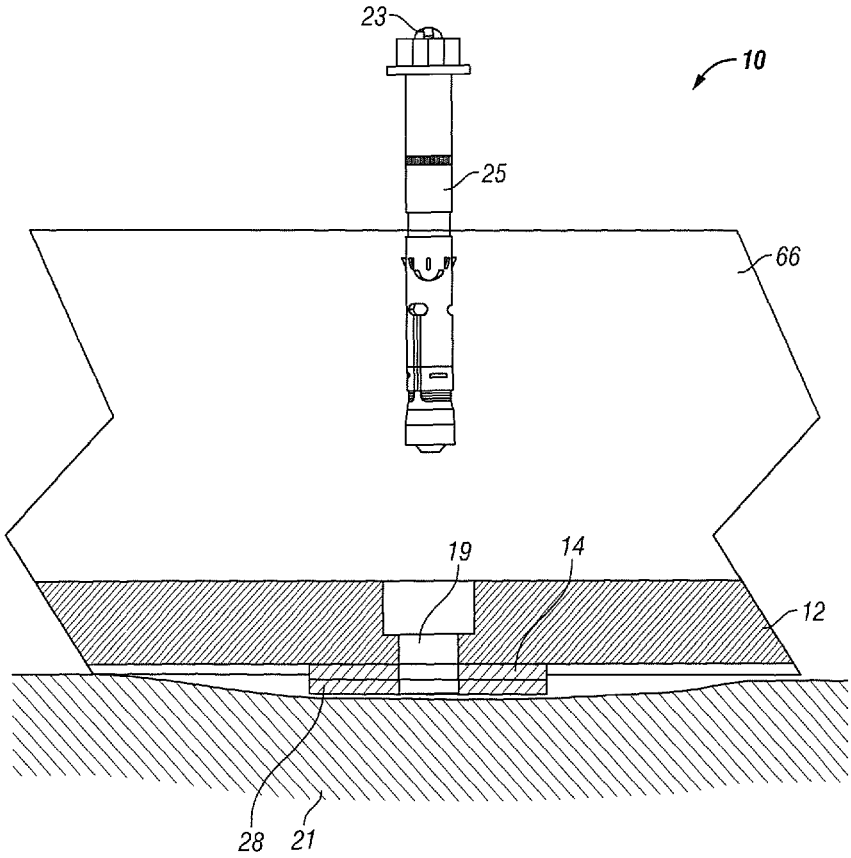
FIG. 13 is a side view of an embodiment of an architectural alignment system in accordance with the present invention shown with a panel system and a mounting bolt.
Figure 14:
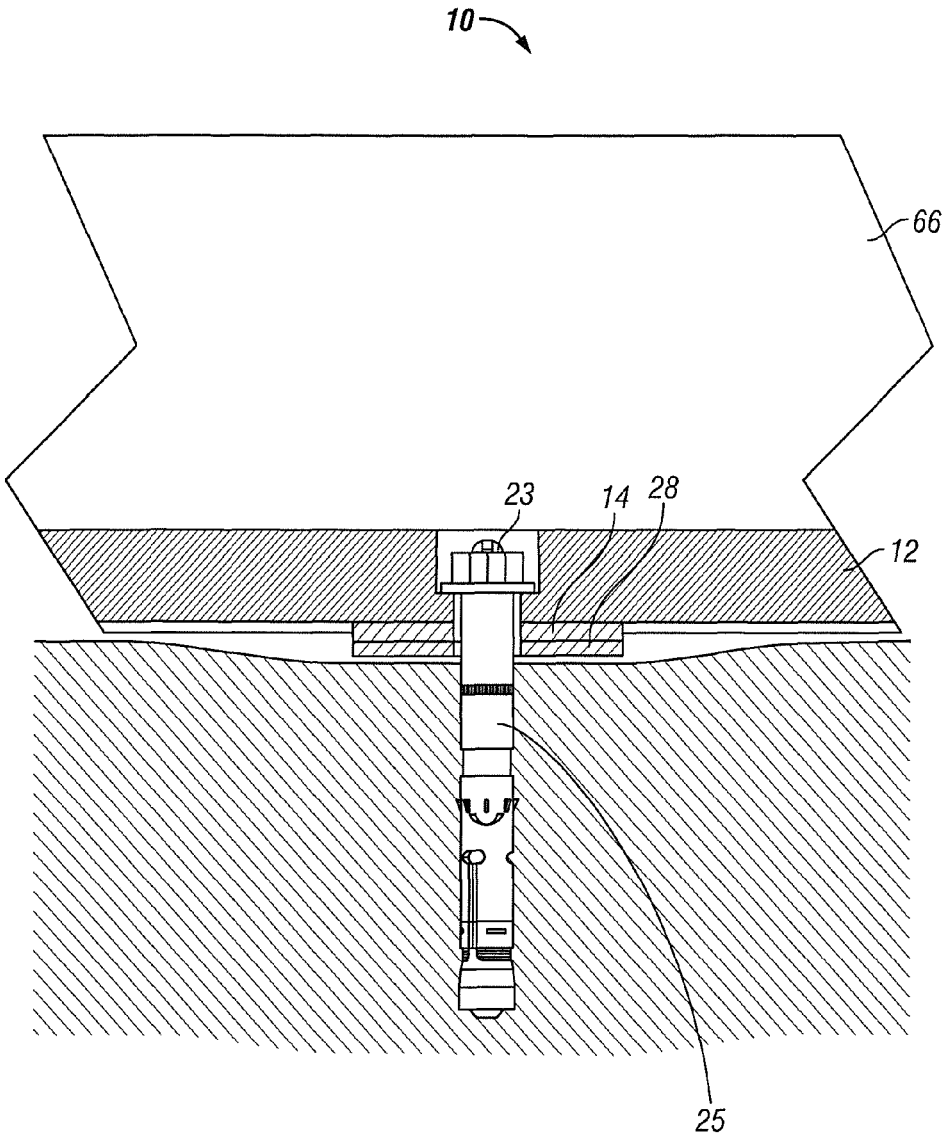
FIG. 14 is a side view of an embodiment of an architectural alignment system in accordance with the present invention shown with a panel system and a mounting bolt.
Figure 15:
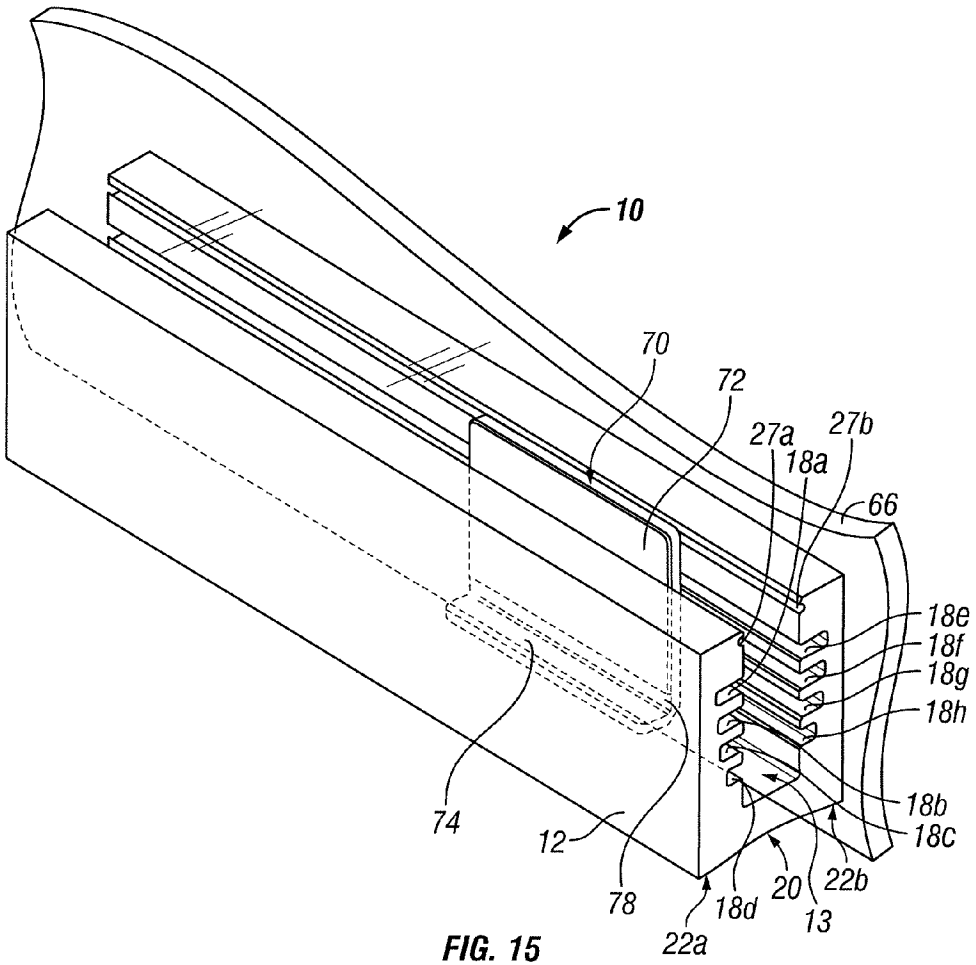
FIG. 15 is a perspective view of an embodiment of a spacer of a panel locking system in accordance with the present invention shown with an embodiment of a base shoe and panel.

In the loosely bolted state, the installer adjusts and/or rotates the base shoe 12 to achieve vertical plumb. There are various known ways to adjust for plumb and level, including using a PAL tool. The concave base surface 20 of base shoe 12 on mounting pad 14 allows the installer to correct for grade changes in the mounting substrate 21 along the length of base shoe 12. More particularly, base shoe 12 can be moved forward or backward up to 3 degrees until the base shoe 12 is plumb. The base shoe 12 could also be rotated if necessary. As shown in FIGS. 13 and 14, once the base shoe 12 is plumb and level, anchor 25 may be inserted through bolt hole 19 and bolt 23 may be tightened in accordance with appropriate specifications to secure base shoe 12 to mounting substrate 21.

Figure 18:
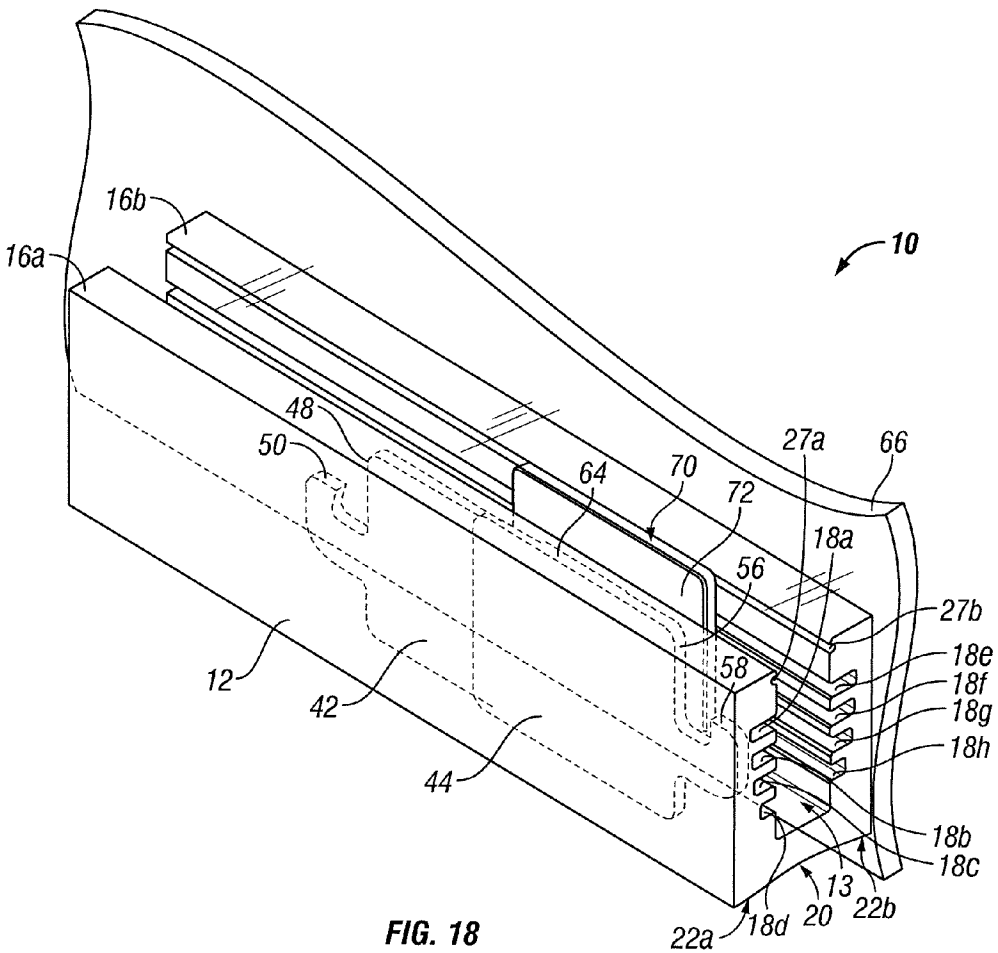
FIG. 18 is a perspective view of an embodiment of a panel locking system in accordance with the present invention shown with an embodiment of a base shoe and panel.

Once proper alignment of the base shoe 12 is achieved, a panel may be installed, for example, as shown in FIGS. 15-18. First, the installer inserts one or more spacers 70 into the base shoe 12. It should be noted that spacer 70 and plates 42 and 44 of panel locking assembly 40 can be used with a number of different base shoes and panels including the architectural alignment system of the present invention. The panel 66 to be installed is lowered into base shoe 212 so the bottom edge of the panel 66 rests on short leg 74 of spacer 70, as can best be seen in FIG. 15. In this example, panel 66 is secured to short leg 74 by sticking the bottom edge of the panel 66 to the short leg using some form of adhesive (not shown). First plate 42 and second plate 44 are attached using gib projection 52 on the top of first plate 42, which engages second plate 44. Thus, plates 42 and 44 are in an engaged and overlapping position with respect to each other, as shown in FIG. 18. The two plates then are inserted into the base shoe 12 on the man side of the panel 66 such that first plate 42 contacts the inner surface of base shoe 12 and second plate 44 contacts the man side of the panel 66. Alternatively, the tapered locking plates may be inserted sequentially, with first plate 42 inserted into the base shoe 12 first and second plate 44 inserted next.

The installer then slides second plate 44 toward first plate 42, thereby narrowing the space within the base shoe 12 and applying the requisite compressive force to hold panel 66 in place. Upon completion of the panel securing process and application of the base shoe's decorative cladding, it is desirable to inject a bead of silicone along both sides of panel 66 in the groove resulting from the panel and base shoe's inner surfaces and above plates 42 and 44. The silicone serves as both an aesthetic finish and a moisture barrier. For extraction of the panel, e.g., for any adjustments, the installer uses the selected mechanism to slide second plate 44 away from first plate 42 to widen the space in the base shoe 12 and release the panel 66. In some embodiments, both first plate 42 and second plate 44 may be movable in relation to each other.

The complementary tapered surfaces of second plate 44 and first plate 42 overlap, thereby narrowing the space within base shoe 12 and applying the requisite compressive force to hold panel 66 in place. urging the second plate to slide away from first plate 42. The complementary tapered surfaces of second plate 44 and first plate 42 disengage, thereby widening the space within the base shoe 12, easing the compressive force and releasing panel 66.

Operation of fascia mounting assembly 80 to secure the architectural alignment system to the side surface of a building is the same in terms of installing the panel in the base shoe 12 using panel locking assembly 40. To align the architectural mounting system to the side surface of a building, a bolt is inserted through bolt hole 119 in side wall **16*a* of base shoe 12, through fascia mount 11 and through the U-shaped gap in mounting pad 14 to the side mounting surface of the building. Base shoe 12 is loosely bolted to the mounting surface of the building. In this loose state, the installer adjusts to achieve vertical plumb of the panel system. The concave base surface 120 of fascia mount 11 on mounting pad 14 allows the installer to correct for grade changes in the side mounting surface of the building along the length of base shoe 12. If the side mounting surface of the building has irregular pockets, one or more of the shims 28, 30, 32 may be inserted under mounting pad 14 to achieve level. Once the base shoe 12 is plumb and level, the bolt may be tightened in accordance with appropriate specifications to secure base shoe 12** to the side mounting surface of the building.

Thus, it is seen that an architectural alignment system is provided. It should be understood that any of the foregoing configurations and specialized components may be interchangeably used with any of the systems of the preceding embodiments. Although illustrative embodiments of the present invention are described hereinabove, it will be evident to one skilled in the art that various changes and modifications may be made therein without departing from the invention. It is intended in the appended claims to cover all such changes and modifications that fall within the true spirit and scope of the invention.

What is claimed is:

1. A method of aligning a panel, comprising:

providing a longitudinally extended base shoe defining a longitudinally extended channel and having two side walls and a concave base surface on an opposite side of the base shoe from the channel, the base shoe having a first longitudinal length;

providing a plurality of mounting pad inserts, each mounting pad insert having a second longitudinal length, the second longitudinal length less than the first longitudinal length, the mounting pad insert further having a bottom surface having a bottom surface profile corresponding to that of a mounting substrate surface and a convex top surface profile corresponding to the concave base surface of the base shoe, the mounting pad insert positioned between the base surface and the concave base surface with the convex top surface of the mounting pad positioned adjacent the concave base surface and the bottom surface positioned in the direction of the mounting substrate surface; and placing the base shoe on the mounting substrate;

inserting the plurality of mounting pad inserts under the base shoe such that the top surface of the mounting pad is adjacent the base surface of the base shoe; and adjusting the angular displacement of the base shoe in relation to the top surface of the mounting pad.

2. The method of claim 1 further comprising loosely bolting the base shoe to a mounting substrate.

3. The method of claim 1 further comprising adjusting the panel system to achieve vertical plumb.

4. The method of claim 1 further comprising inserting one or more shims beneath the mounting pad to achieve level.

5. The method of claim 1 further comprising inserting a panel locking assembly within the base shoe.

6. The method of claim 5 comprising installing a panel into the panel system.

7. The method of claim 6 wherein the installing comprises:

inserting a spacer into the channel of the base shoe;

resting a panel on the spacer;

inserting a first tapered plate into the base shoe between one of the base shoe sidewalls and the panel, inserting a second tapered locking plate into the base shoe, between one of the base shoe sidewalls and the panel and at least partially overlapping with the first tapered locking plate, the first tapered locking plate being partially positioned between the second tapered locking plate and the panel;

moving one or both of the first tapered locking plate and the second tapered locking plate laterally in relation to one another to generate a compressive force on the panel.

* * * * *